United States Patent [19]

Pesce et al.

[11] 4,391,230

[45] Jul. 5, 1983

[54] WATER-ALCOHOL INJECTION APPARATUS FOR I.C.E.

[76] Inventors: Eugene B. Pesce, 1724 S. Quince St., Escondido, Calif. 92025; James A. Krikava, 1110 Lancer La., West, Tarpon Springs, Fla. 33589

[21] Appl. No.: 242,021

[22] Filed: Mar. 9, 1981

[51] Int. Cl.[3] ..... F02D 19/00; F02M 25/02

[52] U.S. Cl. ..... 123/25 E; 123/252; 261/18 A; 261/DIG. 66

[58] Field of Search ..... 123/25 R, 25 A, 25 E, 123/25 L; 261/18 A, DIG. 66

[56] References Cited

U.S. PATENT DOCUMENTS

| | | | |
|---|---|---|---|
| 3,141,447 | 7/1964 | Jernigan | 261/18 A |
| 3,716,040 | 2/1973 | Herpin | 261/18 A |
| 3,856,901 | 12/1974 | Newmann et al. | 123/25 R |
| 3,975,466 | 8/1976 | Bradshaw | 123/25 R |
| 4,119,062 | 10/1978 | Treuaskis et al. | 261/18 A |

*Primary Examiner*—Ira S. Lazarus

*Attorney, Agent, or Firm*—Ronald E. Barry

[57] ABSTRACT

A water-alcohol injection apparatus for an internal combustion engine having a crankcase and a carburetor mounted on the air fuel manifold of the engine, the apparatus including a reservoir for a water-alcohol mixture, a main reservoir conduit connected to the reservoir, a first conduit connecting the main conduit to manifold to provide a continuous flow of the fluid mixture to the manifold, a second conduit connecting the main conduit to the carburetor to provide fluid mixture flow in response to demand and a third conduit connecting the crankcase to the first conduit, the third conduit including a pressure compensating valve to control the flow of crankcase emissions to the carburetor.

5 Claims, 1 Drawing Figure

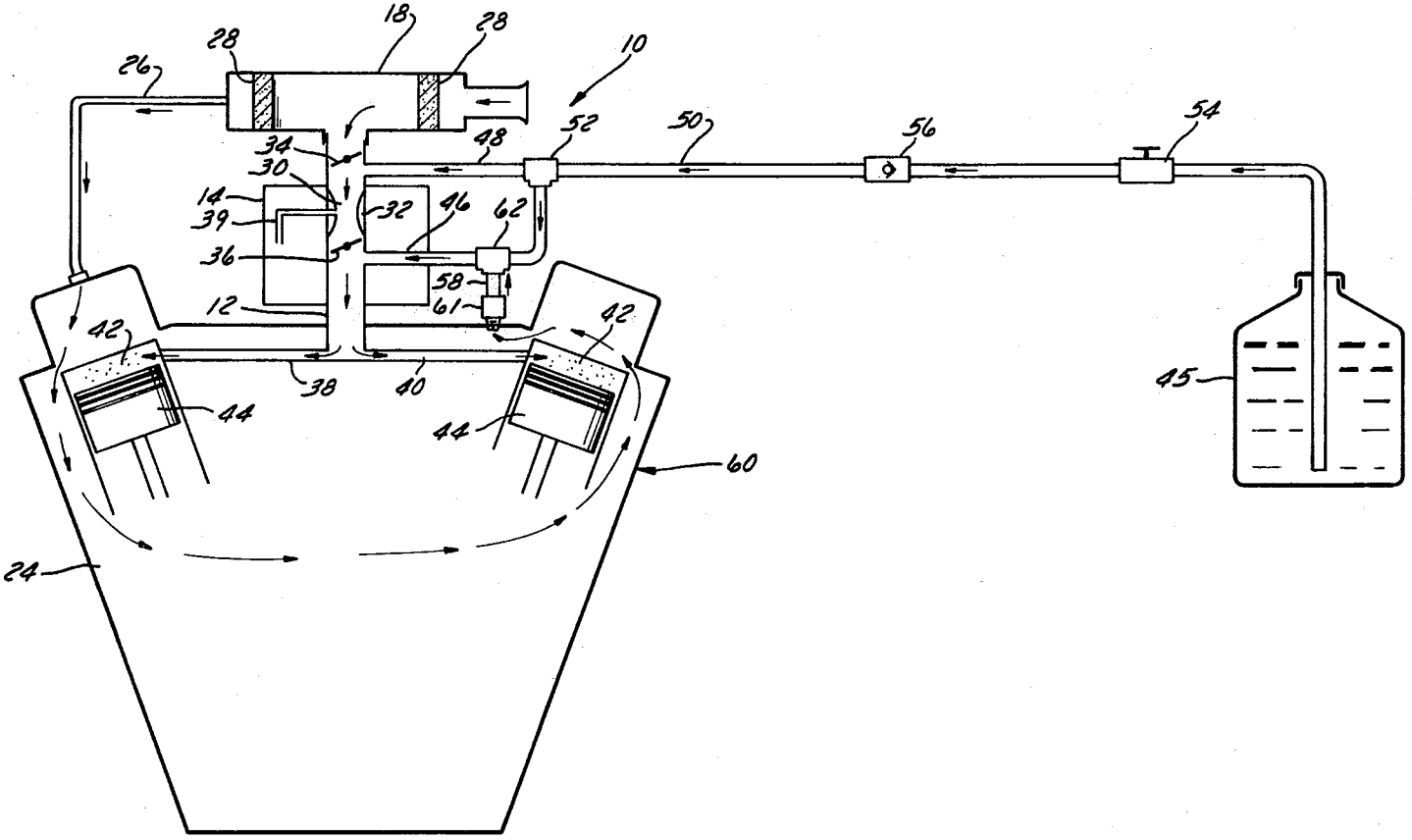
10
12
14
18
24
26
28
28
30
32
34
36
38
39
40
42
42
44
44
45
46
48
50
52
54
56
58
60
61
62

WATER-ALCOHOL INJECTION APPARATUS FOR I.C.E.

BACKGROUND OF THE INVENTION

Injection of fluid mixtures in the form of vapors or gases into the air intake streams of internal combustion engines in aircraft is well known. Alcohol-water mixtures have been introduced into these engines to reduce preignition and allow higher effective power when required. Alcohol-water mixtures have been used because of the extremely high latent heat of vaporization of the mixture. However, the use of such devices in automobile engines has met with limited success. This has been due to some extent to the limited ability of these systems to provide an increased quantity of the mixture at times of increased load or acceleration or in less quantities when less mixture is needed.

The scarcity and increasing costs of hydrocarbon fuels coupled with the federal regulations governing permissible emissions from internal combustion engines used in automobiles and the like have created a need for a system to lower emissions and/or increase efficiency in the internal combustion engines. Techniques for lowering emissions have been primarily directed to systems such as catalytic converters and air injector reactor systems and the like for removing toxic or otherwise undesirable emissions from the exhaust. Such systems produce no useful work and therefore do not increase efficiency.

SUMMARY OF THE PRESENT INVENTION

In accordance with the present invention, a fuel mixture injection apparatus is provided which operates in conjunction with a conventional carburetor to inject a mixture of water and alcohol directly into the intake manifold of the engine. The mixture is provided under normal operating conditions at a preselected rate with provision being provided for increasing the admission of fuel into the system when increased power is required. Crankcase emissions are recycled through the injector system to improve the efficiency of combustion of the fuel without decreasing the available power from the engine. The fuel mixture injection system may be readily installed on conventional internal combustion engines without major modifications of the conventional fuel system. The injector system is completely fail-safe and can be made from readily available materials.

In the drawing a partial schematic sectional view of the invention is shown attached to a carburetor for an internal combustion engine.

DETAILED DESCRIPTION OF THE INVENTION

As seen in the drawing, the fluid mixture injection system 10 is shown connected to the intake manifold 12 of a carburetor 14 for an internal combustion engine 60. An air filter 18 is provided at the top of the carburetor and is connected to the crankcase 24 of the engine by means of a crankcase conduit 26. Air filters 28 may be provided within the air filter as required.

The carburetor is of conventional design having a reduced diameter section or venturi 30 located in the fuel-air passage 32 with a choke valve 34 above the venturi and a throttle valve 36 below the venturi. Fuel from the carburetor is admitted to the passage 32 through a fuel line 39 located in the venturi 30 as generally understood in the art. The manifold is connected to fuel distribution lines 38 and 40 which are connected to the cylinders 42 for the pistons 44.

In accordance with the invention, the injection system 10 includes a reservoir 45 for a fluid mixture such as water and alcohol. The reservoir 45 is connected to the passage 32 by means of a first conduit 46 at a point downstream from the throttle valve 36 and by means of a second conduit 48 located downstream from the choke valve 34 and upstream from the venturi 32. The first and second conduits 46 and 48 are connected to a main reservoir conduit 50 by a T connector 52.

The first conduit 46 forms an open passage to the main conduit 50 to provide a continuous supply of water-alcohol to the engine. The amount is controlled by means of a control valve 54 which may be preset and adjusted as required. Backflow through the main passage is prevented by means of a check valve 56.

Additional water-alcohol mixture is admitted to the carburetor by means of the second conduit 48. The flow of water-alcohol through the second conduit is limited in relation to the first conduit by reducing the size of the second conduit to ½ the size of the first conduit. The second conduit point of entry is located in a position where a minimum vacuum is present under normal operating conditions. The vacuum at that point is controlled by means of the choke valve 34 which is used either at start-up or at times when acceleration of the engine is required.

Fuel emissions collected within the crankcase 24, as a result of blow back from the piston and cylinders is drawn into the first conduit 46 by means of a third conduit 58. The third conduit 58 is connected to the crankcase by means of a pressure-compensating valve (PCV) 61 and to the first conduit 46 through a T connector 62. Air admitted to the crankcase through the conduit 26 will be drawn from the crankcase into the first conduit 46 through the third conduit 58 whenever the engine is operating. The pressure-compensating valve 61 is provided at the connection of the third conduit to the crankcase to prevent blowback into the crankcase. The pressure-compensating valve is of a conventional type having a ball biased by a spring into engagement with a valve seat at the entrance to the crankcase. The bias force of the spring can be set to allow the valve to open whenever the vacuum in the line is sufficient to overcome the spring force.

In operation, on start-up, the choke valve 34 is closed to draw increased fuel into the cylinders in the engine. The increased vacuum in passage 32 will draw water-alcohol through the second conduit which will mix with the air and fuel in the passage 32.

Once the engine starts the choke valve 34 will open and the throttle valve 36 is used to control the speed of operation of the vehicle. Normally a vacuum will exist in the passage 32 downstream of the venturi 30 which will continue to draw fuel as well as the water-alcohol from the reservoir to the first conduit 46. As the vacuum increases in the first conduit the PCV valve will open, drawing any emissions from the crankcase through the third conduit and first conduit into the manifold 12. Any oil emissions thus existing in the crankcase will be recycled to the manifold for complete combustion.

A water-alcohol ratio of 40% water to 60% alcohol has been used successfully with the systems. Approximately two quarts of fluid has been used with two fuel tanks of gasoline.

We claim:

1. An injection apparatus for injecting a fluid mixture of water and alcohol into a fuel distribution system for an internal combustion engine, the fuel distribution system including a carburetor having a throttle valve, the carburetor being connected to the intake manifold of an internal combustion engine which includes a crankcase, said apparatus comprising a reservoir for said fluid mixture, first conduit means connected to said manifold downstream from said throttle valve, second conduit means connected to said manifold upstream from said throttle valve, main passage means connecting said first and second conduit means to said reservoir, one way flow control means in said main passage means for controlling the flow of fluid mixture to the manifold, and a third conduit means connected between said first conduit means and the crankcase of the engine, said third conduit means including a pressure-compensating valve positioned to vent crankcase emissions to said first conduit means.

2. The injection apparatus according to claim 1 wherein said second conduit means is approximately one-half the size of the first conduit means whereby fluid mixture flow is less than the flow through the first conduit means.

3. In an internal combustion engine having a crankcase and a carburetor connected to the crankcase through a manifold to the carburetor including a choke valve and a throttle valve located on each side of a venturi in an air fuel passage in the carburetor, an air flow filter connected to said carburetor, a water-alcohol injection apparatus comprising a reservoir for a water-alcohol fluid mixture, first conduit means connected to said manifold downstream from said throttle valve, second conduit means connected to said manifold upstream from said venturi and downstream from said choke valve, and third conduit means connected between said crankcase and said first conduit means; and main passage means connecting said first and second conduit means to said reservoir whereby said fluid mixture will normally flow through said main passage means and said first conduit means into the manifold and additional fluid mixture will flow through said second conduit means in response to movements of said choke valve.

4. The apparatus according to claim 3 including one way flow control means in said main passage means.

5. The apparatus according to claim 3 including a pressure-compensating valve in said third conduit whereby fuel emissions in said crankcase will be drawn into said first conduit means through said pressure-compensating valve.

* * * * *